US005385299A

United States Patent [19]

Zawada

[11] Patent Number: 5,385,299

[45] Date of Patent: Jan. 31, 1995

[54] FRESH AIR INTAKE SYSTEM FOR A DWELLING HAVING CENTRAL FORCED WARM AIR HEATING

[76] Inventor: Michael E. Zawada, 593 Peakham Rd., Sudbury, Mass. 01776

[21] Appl. No.: 844,789

[22] Filed: Mar. 2, 1992

[51] Int. Cl.[6] ..... F24B 7/00; F24B 7/02; F24B 7/04

[52] U.S. Cl. ..... 237/55; 126/110 R; 126/117; 165/70; 165/901; 165/154

[58] Field of Search ..... 165/47, 901, 70, 154; 237/55, 12.3 A; 126/110 R

[56] References Cited

U.S. PATENT DOCUMENTS

| | | | |
|---|---|---|---|
| 999,487 | 8/1911 | Dilks et al. | 237/12.3 A |
| 1,068,516 | 7/1913 | Matthews | 237/12.3 A |
| 1,590,248 | 6/1926 | Machado | 237/12.3 A |
| 1,638,317 | 8/1927 | Bowers | 237/12.3 A |
| 1,775,607 | 9/1930 | Tranchell | 237/12.3 A |
| 2,316,273 | 4/1943 | Meyer et al. | 165/70 |
| 2,356,392 | 8/1944 | Fluor | 237/55 |
| 2,823,026 | 2/1958 | D'Amico et al. | 165/901 |
| 2,962,218 | 11/1960 | Dibert | 237/55 |
| 3,527,293 | 9/1970 | Meisse et al. | 165/70 |
| 4,054,981 | 10/1977 | Bridgegum | 165/70 |
| 4,138,062 | 2/1979 | Graden | 165/901 |
| 4,729,425 | 3/1988 | Mitchell | 165/47 |
| 4,887,586 | 12/1989 | Walters | 237/55 |

*Primary Examiner*—John K. Ford
*Attorney, Agent, or Firm*—Robert T. Dunn

[57] ABSTRACT

In a dwelling having a forced warm air type central heating system in which the source of heat is the hot gas products of combustion in a furnace, ambient fresh air is introduced into the dwelling to improve the quality of air in the dwelling by a fresh air input duct to the fresh air input of a relatively low temperature flue gas to the fresh air heat exchanger so that the fresh air is warmed and the fresh air output of the heat exchanger is connected by a duct to the forced warm air heating system so that the warmed fresh air is entrained with the air in the system. In a preferred embodiment, the flue gas to fresh air heat exchanger is attached to a section of the furnace flue pipe that is covered by a thermally conductive gas barrier and includes an enclosure for enclosing the outside barrier covered surface of the section of the furnace flue pipe forming an annular space between the gas barrier and the enclosure through which the fresh air flows and is warmed by heat from the flue gas.

10 Claims, 3 Drawing Sheets

FRESH AIR INTAKE SYSTEM FOR A DWELLING HAVING CENTRAL FORCED WARM AIR HEATING

This invention relates to forced warm air heating systems in a dwelling and more particularly to a method and equipment of introducing fresh air into the system.

BACKGROUND OF THE INVENTION

During the winter months, most houses and dwellings are sealed tight to prevent heat loss and often the homeowner has installed energy efficient windows, extra wall and ceiling installation and replaced worn weather stripping. All this directly benefits the homeowner by curing drafty doors and windows and limits heat loss through walls and ceilings so that the homeowner incurs less cost to heat the house. However, sealing the home against heat loss creates another problem. The air in the house becomes stale. Even though the air is recirculated, it contains cooking odors, smoke, cleaning sprays and other household pollutants and also may harbor germs and viruses. One solution to this problem is to change the air.

In a forced warm air heating system, room air circulates through the house giving up its heat and returning through the the return air ducts and filter back to the furnace. In the furnace, a blower forces the air over a heat exchanger and the air flows from the heat exchanger through ducts that spill the air through room registers into the rooms of the house. The furnace flue carries unburned gas and particulate matter to the house chimney through which the gas rises and spills into the atmosphere. Clearly, the furnace combustion area heat exchanger and flue are all sealed so that no products of combustion can leak from any of these parts into the house or into the warm air heating system and all flue gas flows up the chimney and into the atmosphere outside, usually above the roof of the house.

Heretofore, flue gas to air heat exchangers have been employed for pre-heating the combustion air to a furnace of the central heating unit of a house. Usually, the central heating unit furnace is in the ground or basement part of the house and draws upon air from inside the house for combustion in the furnace. Efforts are sometimes made to pre-heat the air before combustion, using a flue gas to air heat exchanger in the flue stack from the furnace. Heretofore, a great deal of effort has been made to provide such a heat exchanger that is both efficient and economical in cost and installation. With such a pre-heater, flue gas leaking into the combustion air does not cause a problem or danger to the occupants of the house, so long as all of the pre-heated air flows into the furnace combustion chamber and none leaks into the house. The present invention has no intention of improving upon such heat exchangers or of improving combustion operation or efficiency of a furnace.

SUMMARY OF THE INVENTION

It is an object of the present invention to provide a method and means of drawing fresh air into a house or dwelling that has forced warm air central heating wherein the source of heat is a furnace that burns fuel and has an exhaust flue from the furnace to the outside of the house.

It is another object of the present invention to provide a method and means of efficiently heating air drawn into the house from outside and heating the air drawn in without additional heating or use of fuel over and above the fuel used normally in the central heating system furnace.

The present invention addresses some of the problems involved in ventilating the house and in particular provides a method and means of drawing fresh air into the house using an existing forced hot air central heating system in the house so that the fresh air drawn in is treated by the system filters and other air treatment facilities of the system. Heretofore, very little effort has been made to ensure that there is a steady flow of fresh air into a house and so ensure a change of the air over a period of time to avoid a buildup of undesirable airborne dust, pollen, smells and gases and including radon gas, which is known to build up in some houses as it leaks into the house through the ground subsurface. Radon gas can have a negative effect on the health of people living in the house. Many, or even most, houses in the United States are not air tight and a certain amount of ambient air from the outside simply leaks into the house through doors, windows, cracks, etc. and so there is over time some exchange of the air in the house that tends to reduce the accumulations mentioned above.

The embodiment of the present invention described herein has use in a house or dwelling having a forced warm air type central heating system in which the source of heat is the hot gas products of combustion in a furnace. According to the present invention, ambient fresh air is introduced into the house to improve the quality of air in the house by a fresh air input duct to a relatively low temperature flue gas to fresh air heat exchanger, so that the fresh air is warmed and the warmed fresh air from the heat exchanger is fed by a duct to the existing forced warm air system in the house, so that the warmed fresh air is entrained with the air in the system. In a preferred embodiment, the flue gas to fresh air heat exchanger (herein called the preheater) is attached to a section of the furnace flue pipe and includes a gas barrier sleeve that wraps around the section of flue pipe providing a thermally conductive gas barrier between the flue pipe and the fresh air flowing through the heat exchanger. An annular space between the outside surface of the sleeve and the enclosure conducts fresh air that is warmed by heat from the flue gas.

DESCRIPTION OF EMBODIMENTS OF THE INVENTION

Figure 1:
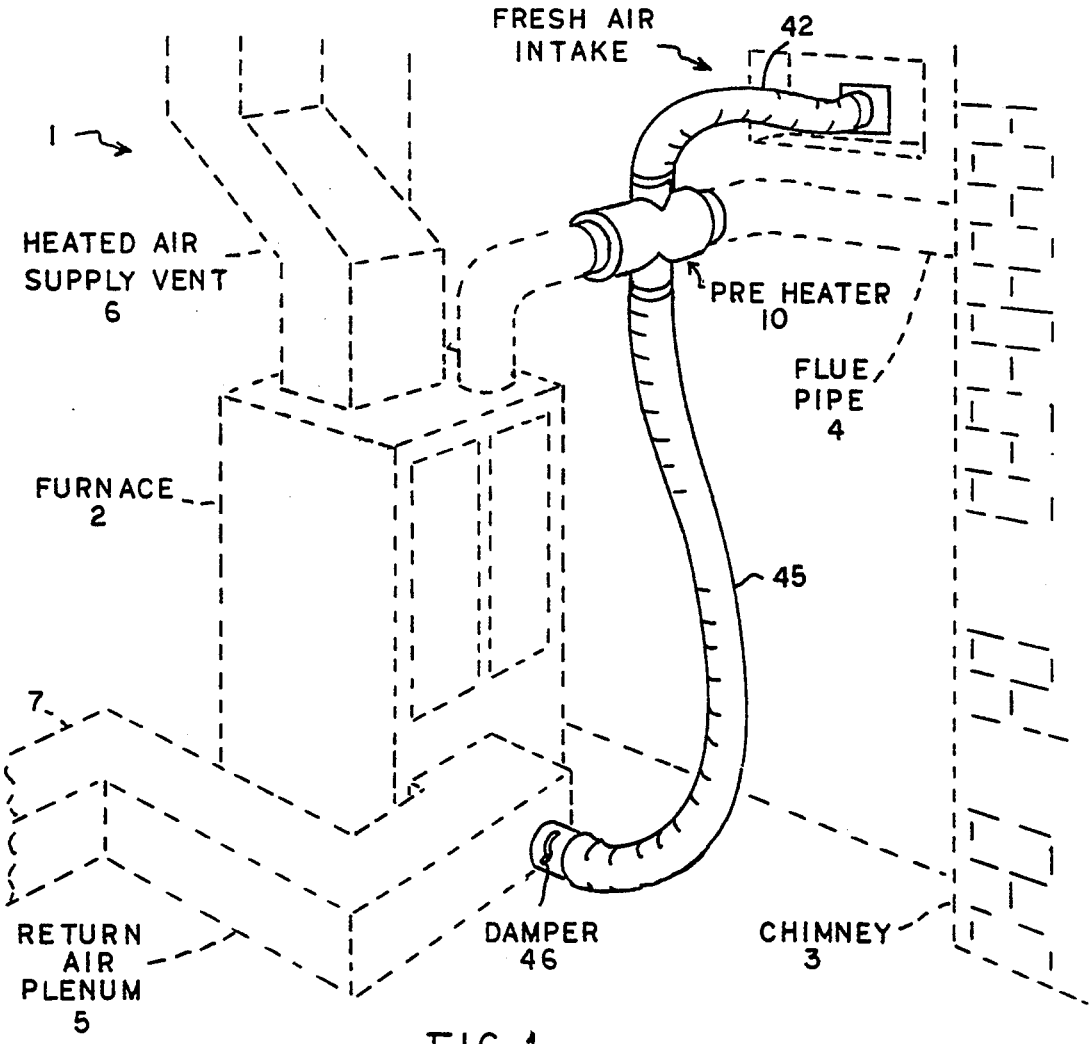
FIG. 1 of the drawings is a perspective view of the fresh air pre-heater of the present invention (shown by heavy solid lines) connected to a typical conventional forced warm air heating system (shown by broken lines) and which includes a furnace and chimney, flue pipe from the furnace to the chimney, return air plenum from rooms in the house to the furnace and heated air supply vent from the furnace to rooms in the house, and in which the fresh air pre-heater and parts thereof that connect it to the fresh air intake and to the return air plenum are shown by heavy solid lines.

The fresh air input system of the present invention is an adaptation to the conventional forced warm air heating system that is used widely throughout the United States. The fresh air input system and a conventional forced warm air heating system are shown in FIG. 1. That figure is a perspective view of fresh air pre-heater equipment 10 of the present invention (shown by heavy solid lines) connected to a typical forced warm air air heating system 1 (shown by broken lines) and which includes a furnace 2 and chimney 3, flue pipe 4 from the furnace to the chimney, return air plenum 5 from the return ducts 7 from rooms in the house to the furnace and heated fresh air supply duct 6 from the furnace to rooms in the house; and in which the fresh air pre-heater equipment 10 and parts thereof that connect it to the fresh air intake 11 and to the system return air plenum 5 are shown by heavy solid lines. The flue gas to fresh air heat exchanger (air pre-heater) assembly 12 of the equipment is shown enlarged in FIG. 2 attached to section 4a of flue pipe 4.

Figure 2:
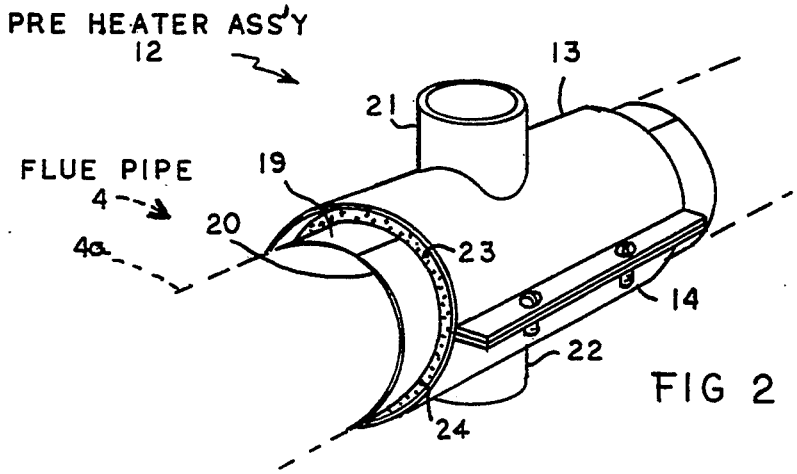
FIG. 2 of the drawings is a perspective view of the fresh air pre-heater of the present invention (shown by heavy solid lines) and part of the furnace flue pipe of the existing forced warm air heating system in the house.
Figure 6:
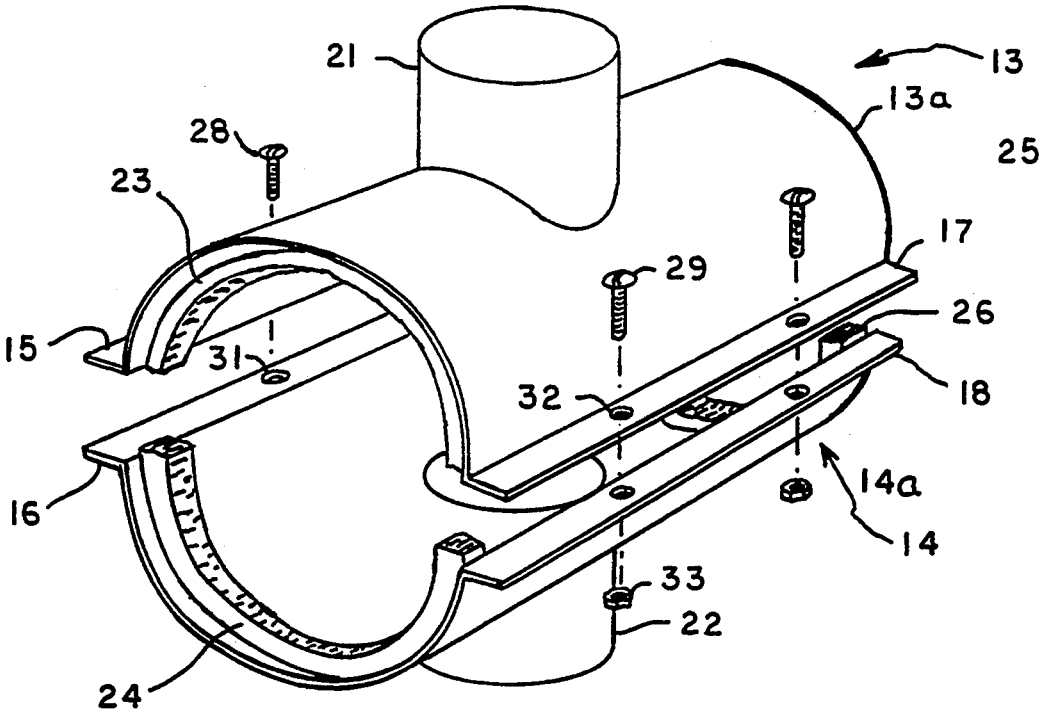
FIG. 6 is a perspective, partially exploded view of the two shells of the fresh air heat exchanger that is attached to the section of flue pipe that is enclosed by the gas barrier sleeve shown in FIG. 7.
Figure 7:
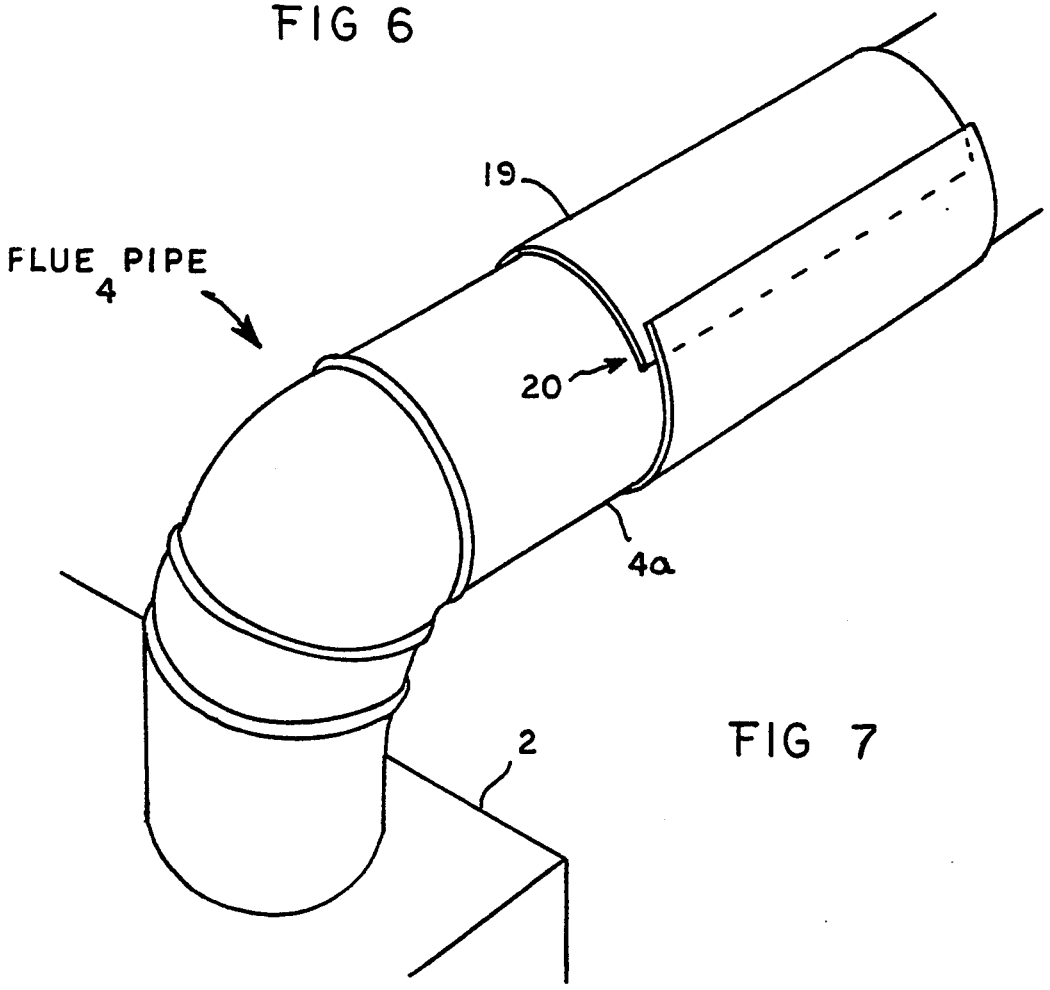
FIG. 7 is a perspective view of the gas barrier sleeve.

As shown in FIGS. 2, 6 and 7, the preheater 12 includes two shells 13 and 14 that attach together enclosing a section of the flue pipe that is covered by a thermally conductive gas barrier sleeve 19 (shown in FIG. 7). The purpose of sleeve 19 is to cover the section of flue pipe and prevent any flue gas that may leak through the section from entering the fresh air flow path through the pre-heater. For that purpose, the sleeve may be made of a thin sheet of metal that overlaps itself at 20 and fits in intimate thermal contact with the section of flue pipe and is preferably slightly longer than shells 13 and 14.

Shells 13 and 14 may be formed of twenty six gauge galvanized steel sheet or cut from galvanized steel pipe of that gauge and of a size about an inch greater than the size of flue pipe 4. Each of the shells has two longitudinal flanges 15 and 17 on shell 13 and 16 and 18 on shell 14 that may be continuations of the cylindrical parts 13a and 14a of the shells, respectively, or may be attached to the cylindrical part by, for example, welding thereto. If the shells are formed from steel sheet, they are formed with the flanges as continuations of the cylindrical parts and the cylindrical parts define a diameter larger than the diameter of the flue pipe by an inch or more.

Shell 13 includes the fresh air input stub 21 that may be cut from twenty six gauge galvanized steel pipe three or four inches in diameter, that is preferably welded thereto as shown. Similarly, shell 14 includes the fresh air output stub 22 that is welded thereto as shown.

On the inside of the shells at the longitudinal ends thereof is a resilient air sealing material, 23 and 25 on shell 13 and 24 and 26 on shell 14, respectively. The resilient material must be capable of withstanding the usual high temperature of the furnace flue pipe. A suitable material is a ceramic glass blanket of the kind used for high temperature insulation. The flue gas temperature can be several hundred ° F. The purpose of this air seal material is to seal the ends of the annular space 27 formed between the shells and sleeve 19 on the section of flue pipe (see also FIG. 3). These seals serve to seal the ends of that annular space so that the fresh air flow into that space does not leak out of the ends and they also serve to space the shells evenly from the sleeve covered flue pipe so that the annular space 27 is uniform along the heat exchanger.

At attachment of the shells to the section of flue pipe, first the section 4a of the flue pipe is carefully inspected to be sure that there are no punctures or leaks in that section of the pipe. Then, sleeve 19 is wrapped around the section of pipe so that the ends of the sleeve overlap as at 20 in FIG. 7. Next, the shells are fit against opposite sides of the sleeve covered flue pipe section as shown in FIG. 6 and bolts 27 on one side and 28 on the opposite side of the shells are inserted into mating holes 31 and 32 of the mating flanges and nuts 33 and 34 are screwed onto the bolts, forcing the mating flanges together, squeezing the air sealing material 23 to 26 at the ends of the shells against the outside of the sleeve covered flue pipe. Thus, the annular space 27 is reasonably well sealed so that substantially all of the fresh air that enters stub 21 circulates around the section of sleeve covered flue pipe and flows out of stub 22.

Figure 3:
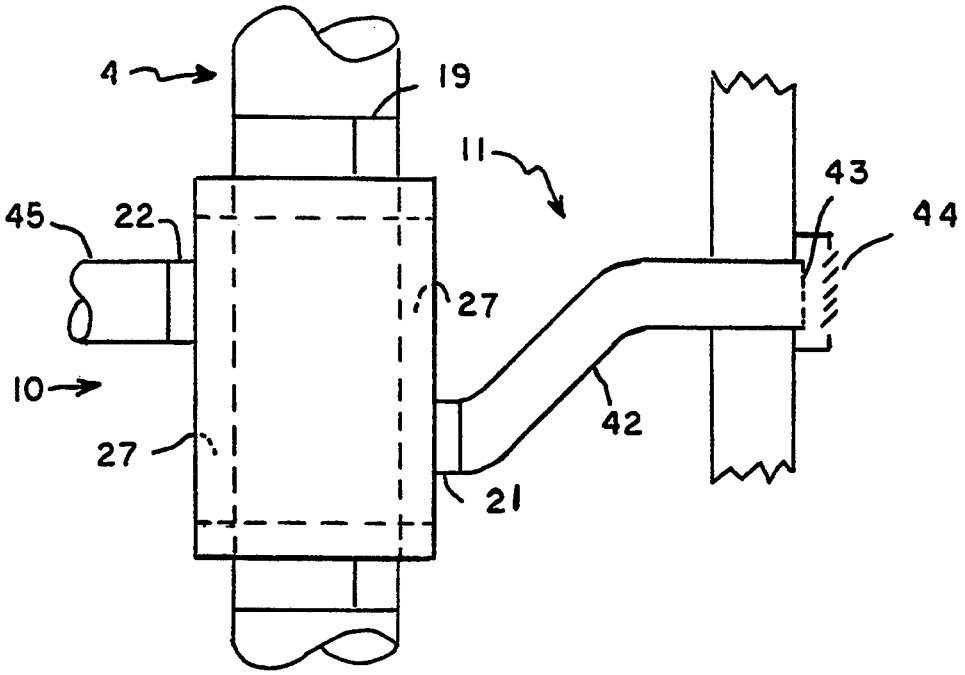
FIG. 3 is a schematic view showing the existing furnace flue pipe inside the house, the immediately adjacent house wall and the arrangement of a fresh air duct, the flue gas to fresh air heat exchanger and a duct conducting warmed fresh air to the forced warm air duct system in the house.

As shown in FIG. 1, the flue gas to fresh air heat exchanger apparatus 10 is integrated into the existing forced warm air furnace and air system 1 inside the house, usually in the basement next to the house chimney 3. The flue gas to fresh air exchanger (pre-heater) 12 handles the relatively high flow rate of hot furnace exhaust gas. The temperature of the usual furnace exhaust gas can be as high as 400° F., but is usually lower, about 150° F. to 200° F. As shown in FIGS. 1 and 3, the heat exchanger apparatus includes a duct 42 for fresh ambient outside air that connects to an intake duct 11 through the wall of the house that may be equipped on the outside of the house with a screen 43 against entrance by insects and, if desired, a hinged cover 44 that opens to admit fresh air from outside when there is a slight draw inside the vent.

In the heat exchanger shown herein, the annular cavity 27 is provided around the sleeve covered flue pipe and the fresh ambient air drawn in circulates through this annular cavity. From the output stub 22 an output duct 45 carries the fresh ambient air that is warmed by the exchange to the forced warm air return plenum 5 of the central heating system as shown in FIG. 1, and a damper 46 may be included where duct 45 feeds into plenum 5.

Figure 4:
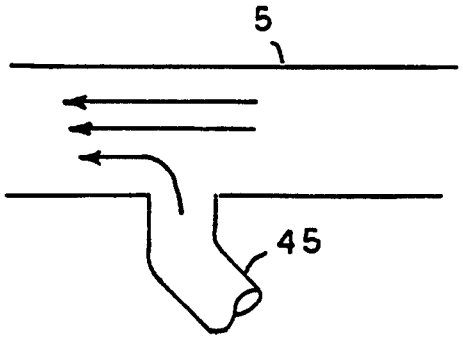
FIG. 4 is a schematic showing the connection of the warmed fresh air duct to the forced warm air system in the house.

As shown in FIGS. 3 and 4, the outside air drawn in through the heat exchanger is drawn by slightly lower static pressure in return air plenum 5, created by the system fan in the furnace, the return plenum 5 being at the low pressure side of the fan and the supply air vent 6 being on the high pressure side. The system fan maintains the forced warm air system circulation between return and supply ducts 6 and 7.

Figure 5:
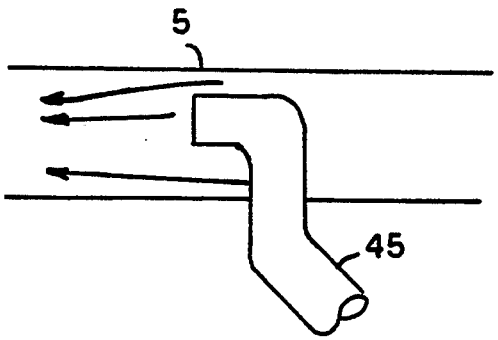
FIG. 5 shows another such arrangement whereby the warmed fresh air is drawn into the duct system.

Another duct feed structure for feeding warmed fresh air into the return system duct 7 is shown in FIG. 5 where the outside air from the heat exchanger is entrained with the air in the return duct 7 where the velocity of flow is greater than in the return plenum. Here again, the pressure of the system air flowing in the duct is lower than outside ambient pressure, which tends to draw in the outside air through heat exchanger 10 and entrain it with the forced air flow in the return duct.

Static pressure in the forced warm air return duct is often a few inches of water lower pressure than outside ambient pressure to draw in a substantial flow of fresh outdoor air into the heat exchanger. This draw of outside air into the forced warm air system in the dwelling is powered by the fan that drives the system and so the system tends to increase the pressure inside the dwelling so that it may be slightly greater than the outside ambient pressure. As a result there is a positive flow of leakage air from the house through windows, doors, cracks to the outside and a replacement flow back into the house through the same paths.

A forced warm air heating system with the improvement of the present invention insures that there is a steady supply of fresh air into the house via the heating system ducts, which usually contain filters and so the fresh air fed into the system ducts is filtered before it is delivered to the rooms of the house. Thus, with the improvement of the present invention, the general pattern of air flow into the house is controlled so that the fresh air flowing into the house can be filtered, treated, etc. for the benefit of those living in the dwelling.

What is claimed is:

1. In a dwelling forced warm air type central heating system in which the source of heat is the hot gas products of combustion in a furnace and that hot gas is carried from the furnace by a flue pipe to the ambient atmosphere outside the dwelling while the warm air is carried by ducts between the furnace and the rooms of the dwelling, a structure for attachment to said flue pipe and said ducts for improving the quality of air in the dwelling including a flue gas to air heat exchanger attached to said furnace flue pipe, a relatively low temperature fresh air passage through said heat exchanger having an input and an output, an input fresh air flow duct connecting said input to the outside ambient air and an output fresh air flow duct connecting said output to said centrai heating forced warm air system, so that outside ambient fresh air flowing through said heat exchanger is entrained with said forced warm air system and so flows into and mixes with said warm air for distribution throughout said dwelling by said forced warm air heating system, the improvement comprising, (a) said flue gas to air heat exchanger is provided by an enclosure that is formed in two parts so that it fits around and encloses the outside surface of a section of said furnace flue pipe, (b) said enclosure defines an annular space between the outside surface of said flue pipe section and said enclosure, (c) said annular space forms said heat exchanger low temperature air passage and (d) a resilient air sealing material of substantially the same cross-section as said annular space is provided for closing said annular space between the outside of said furnace flue pipe section and said heat exchanger enclosure and spaces said enclosure from said flue pipe section, evenly around said flue pipe section, (e) whereby said ambient fresh air flow into said heat exchanger leaves said heat exchanger through said output thereof.

2. A system as in claim 1 wherein, (a) said resilient air sealing material connects said enclosure to said flue pipe section and prevents said enclosure from contacting said flue pipe section.

3. A system as in claim 1 wherein, (a) said heat exchanger input is attached to one of said enclosure parts and (b) said heat exchanger output is attached to the other of said enclosure parts.

4. A system as in claim 3 wherein, (a) said heat exchanger input and output are located at opposite sides of said section of said furnace flue pipe.

5. A system as in claim 4 wherein, (a) said heat exchanger input ambient fresh air flow direction is perpendicular to said furnace flue gas flow direction through said section of furnace flue pipe.

6. A system as in claim 4 wherein, (a) said heat exchanger output ambient fresh air flow direction is perpendicular to said furnace flue gas flow direction through said section of furnace flue pipe.

7. A system as in claim 5 wherein, (a) said heat exchanger output ambient fresh air flow direction is perpendicular to said furnace flue gas flow direction through said section of furnace flue pipe.

8. A system as in claim 1 wherein, (a) a gas barrier is provided between said enclosure and said furnace flue pipe.

9. A system as in claim 8 wherein, (a) said gas barrier is a thin sheet of thermally conductive material.

10. A system as in claim 9 wherein, (a) said gas barrier thin sheet wraps around said furnace flue pipe section along the entire length thereof that is enclosed by said heat exchanger enclosure.

* * * * *